United States Patent [19]

Gladstone

[11] Patent Number: 4,457,027

[45] Date of Patent: Jul. 3, 1984

[54] HEAD GARMENT FOR PROTECTION OF CLOTHING

[76] Inventor: Maryl E. Gladstone, 1230 N. Walnut St., La Habra, Calif. 90631

[21] Appl. No.: 510,280

[22] Filed: Jul. 1, 1983

[51] Int. Cl.[3] ..... A42B 1/18

[52] U.S. Cl. ..... 2/174

[58] Field of Search ..... 2/46, 174

[56] References Cited

U.S. PATENT DOCUMENTS

| | | | |
|---|---|---|---|
| 1,023,677 | 4/1912 | Pass | 2/174 |
| 2,017,328 | 10/1935 | Taylor | 2/174 |
| 2,420,916 | 5/1947 | Sorge | 2/174 |
| 2,445,487 | 7/1948 | Lester et al. | 2/174 |
| 2,447,561 | 8/1948 | Brenner | 2/174 |
| 2,552,803 | 5/1951 | McGee | 2/174 |

*Primary Examiner*—Doris L. Troutman

*Attorney, Agent, or Firm*—Hubbard & Stetina

[57] ABSTRACT

A hood-like garment which can be comfortably worn over the head of the user to protect clothing being put on or removed from becoming soiled with cosmetics of facial oils is disclosed. The garment is lightweight, flexible, and nonrestrictive of the user's movement and vision and constructed to prevent direct contact of the garment with the user's face and hair. The garment is formed with an aperture in its bottom portion with two embodiments of the garment including an elastic band that permits initial expansion of the aperture for placement over the head and subsequent contraction to position and hold the garment in place. An area of expansion in the garment about the chin provides for positioning the garment and facilitates chin movement. A second aperture formed in the top of the garment may be further provided to facilitate additional locating and positioning of the garment on the user's head.

6 Claims, 6 Drawing Figures

Fig. 1
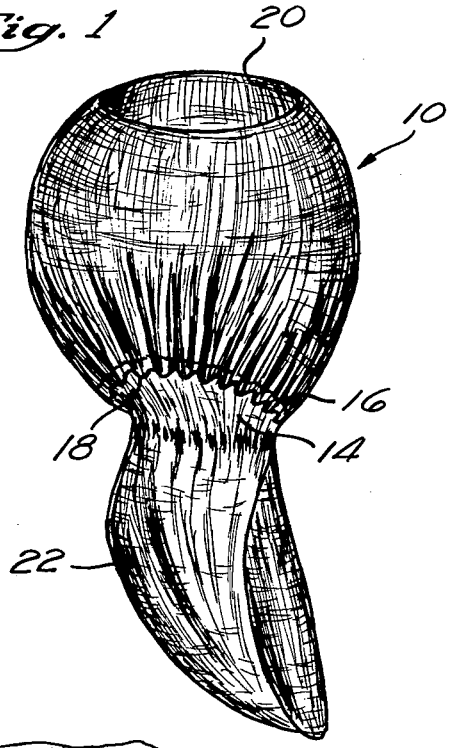
Fig. 2
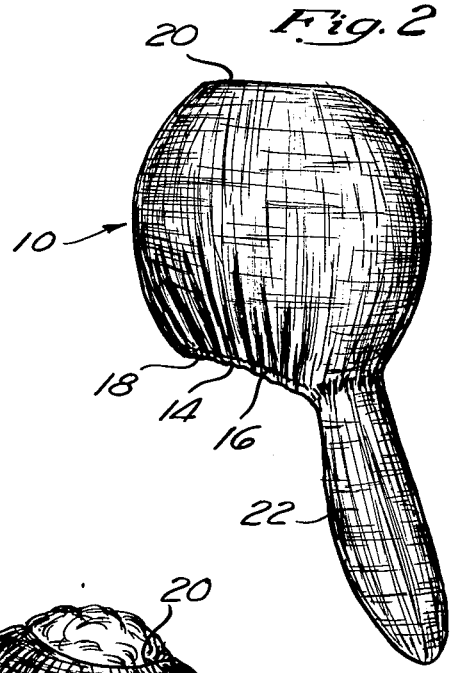
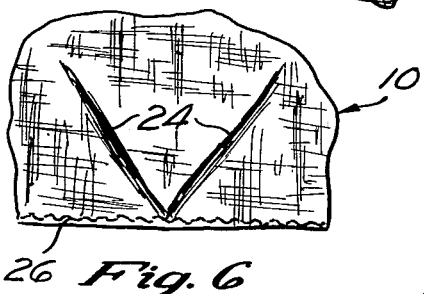
Fig. 6
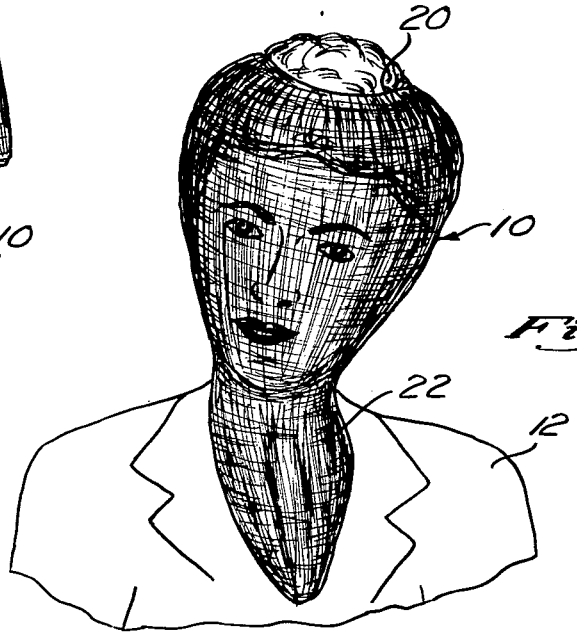
Fig. 3
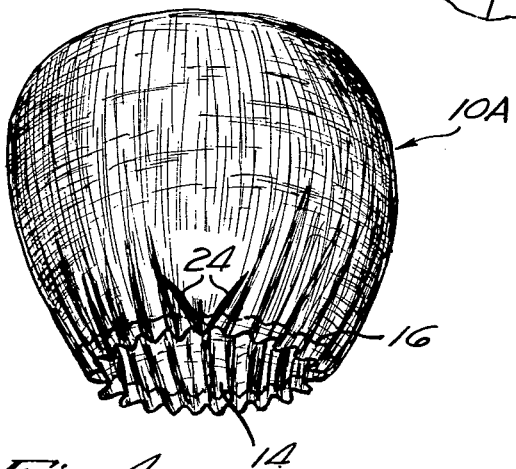
Fig. 4
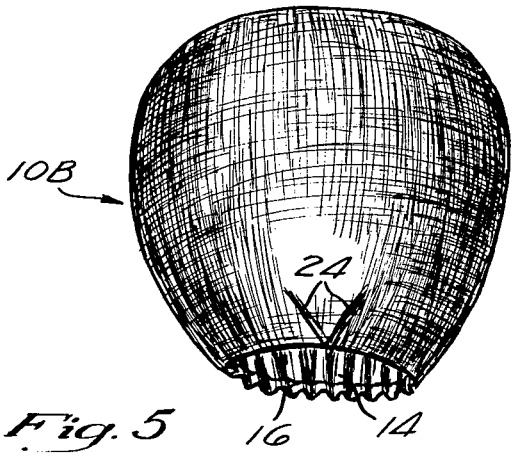
Fig. 5

HEAD GARMENT FOR PROTECTION OF CLOTHING

BACKGROUND OF THE INVENTION

This invention relates broadly to a hood-like garment adapted to be worn about the head of a user, and more particularly, to a bulbous shaped fabric garment which may be worn loosely about the head to protect clothing that is being removed or put on from becoming soiled by the user's cosmetics, facial oils, and the like or becoming damaged as a result of excessive stretching heretofore necessitated in an attempt to prevent such soiling. Further, this invention relates to a garment that is economically manufactured, provides for comfortable and unrestricted use, and is preferably designed to be disposable, thereby being specifically suited for the retail garment sales industry.

In the retail garment sales industry, a major problem encountered is the inadvertent soiling and damaging of garments as they are tried on by perspective customers. This occurs with garments normally put on and removed over the customer's head which, upon direct contact with the user's head, can be soiled by various facial and body cosmetics, perfumes, hair sprays, natural body oils, and the like and can be damaged as a result of excessive stretching in an attempt by the user to avoid such soiling. Soiled garments, or garments scented by these substances, are either less acceptable for sale or require expensive cleaning before they can effectively again be offered for sale. Also, a customer in trying on garments for purchase is often reluctant to do so if the garment would interfere with a hairstyle or the appearance of the customer's cosmetics.

There has been a paucity of prior art devices designed to be worn over a person's head that would protect clothing being offered for sale from being soiled by a customer's cosmetics, and that may be inexpensively manufactured, yet convenient and comfortable for a customer to use. In recognizing these deficiencies, solutions to date have typically been limited to unduly complicated devices incorporating various methods of external attachments and zippers for obtaining a more secure fit. Unfortunately, the prior art is not designed for inexpensive manufacture that would permit single use or quick and convenient use by a customer.

Thus, there exists a substantial need in the art for an improved device which can be easily and conveniently put on by a customer, is designed to be self-locating, may be held comfortably in position without resorting to means for external fixation and can be inexpensively manufactured thereby permitting single disposable use.

SUMARY OF THE INVENTION

The applicant has invented a convenient and economical device for protecting clothes from cosmetics, facial oils and the like which substantially eliminates the deficiencies of the prior art. More particularly, the present invention provides a garment which can be easily and comfortably placed over a user's head before clothes are removed or put on that will then protect the clothes and/or the wearer's cosmetics and hair. The invention is extremely suitable for use in apparel shops where clothes being tried on by customers may be protected from soiling by customers' cosmetics although the device is equally suitable for private use at home.

The invention comprises a generally bulbous garment fashioned like a hood from fabric material that is inexpensive and flexible, designed for single or multiple use, and of porous construction, thereby allowing free air flow and unobstructed vision and movement.

The garment is preferably constructed with an expanding elastic-bound aperture in the bottom of the garment which permits ease of placement over the user's head. The elasticized aperture expands sufficiently to permit easy placement and removal without disturbing hairstyles or makekup, then contracts loosely about the neck to provide a comfortable fit while holding the garment in place. Expanded areas or darts in the chin area of the garment assist in locating the garment on the user's head and in holding the garment in place as well as providing added room for speech. In the preferred embodiment of the invention, an aperture in the top of the garment is additionally provided to assist in locating and stabilizing the garment when worn and a bib extension is attached to the front of the garment sized to extend over and cover the neck and chest areas of the user.

As such, once positioned over the head of the user, the garment prevents any direct contact between the clothing and the user's head and face, and the user may try on clothes without causing soiling or damage to the clothing. Further, the garment expands to accommodate hairstyles during placement and protects both the hairstyle and the user's makeup from direct contact with clothes being tried on.

As will become apparent from the following specification, the invention provides a garment which can be conveniently and comfortably used with essentially no restrictions, and is of a simple construction and material to make manufacture inexpensive thereby being condusive for disposable use.

DESCRIPTION OF THE DRAWINGS

These as well as other features of the present invention will become more apparent upon reference to the drawings, wherein:

FIG. 1 is a perspective view of a first embodiment of the present invention;

FIG. 2 is an elevational view of the first embodiment of the present invention illustrating its basic configuration including a bottom aperture permitting placement, a top aperture for location, and a bib portion sized to extend over the neck and chest of a user;

FIG. 3 is a perspective view of the first embodiment of the present invention worn by a user;

FIG. 4 depicts a second embodiment of the invention having a bottom aperture having a continuous elastic band disposed thereabout;

FIG. 5 depicts a third embodiment of the invention having a bottom aperture with an elastic band extending only in the back portion of the aperture; and FIG. 6 is a fragmentary view of the garment of the present invention illustrating the chin darts which provide for location and freedom of speech and the overlock stitch seam preferably used throughout the garment.

DETAILED DESCRIPTION OF THE PREFERRED EMBODIMENT

Referring to FIGS. 1 through 3, there is shown a first embodiment of the garment 10 of the present invention adapted to be worn about the head of a user 12. The garment is formed in a generally bulbous hood-like configuration preferably formed of a fabric mesh material. It is advantageous that the fabric of the garment 10 is sufficiently flexible or limp to generally conform to hairstyles and the face of the user 12 to thereby allow freedom of movement, is generally porous to allow free exhange or air, and is substantially transparent to allow freedom of vision. Preferred material candidates possessing such characteristics are synthetic fabric fibers, such as sheer polypropylene, formed in a net-like or mesh composition; however, other materials such as paper may be used, as well as a combination of different materials in a multi-fabric design and for purposes of this specification, the term fabric shall be defined to include all materials possessing such properties. Such a fabric construction additionally provides the necessary lightweight and porous properties to insure comfort to the user, yet possesses sufficient strength to allow stitching and the addition of an elastic material thereto. Additionally, such synthetic fibers are easily dyed to allow the garment 10 to be manufactured in a variety of cosmetically pleasing colors.

Referring more particularly to FIGS. 1 and 2, it can be seen that the garment 10 includes an aperture 14 at its base through which the user's head may be inserted. An elastic band 16 is interwoven into the fabric near a seam 18 formed at the edge of the aperture 14 to slightly gather the fabric together.

Preferably the edges of the apertures 14 and 20 are reinforced with a stitching such as overlock stitching or a similar type stitching may be used on all seams during fabrication of the garment. This elastic band 16 permits the aperture 14 to be initially opened sufficiently to allow the garment 10 to be placed over the head of the user 12 without interfering with hairstyles, and then to subsequently close comfortably about the neck of the user to both locate the garment 10 in position and stabilize the garment 10 when in use. A second locating aperture 20, formed having a maximum diameter less than the circumference of the user's head may be provided at the top of the garment 10 to provide for additional registry of the garment 10 about the head of the user 12 when in use.

In this first embodiment, a protective bib portion 22 is attached to the front of the garment 10 which is sized to extend down the front of the neck and over the upper portion of the chest when worn by the user (as illustrated in FIG. 3). The elastic band 16 may or may not be extended completely around the aperture 14 where the bib portion 22 is attached to the garment 10 to insure that the bib portion may remain fully expanded upon the user.

As depicted in FIG. 6, the front portion of the garment 10 preferably includes special chin expansion areas or chin darts. These chin darts 24 assist in positioning the garment 10 on the user's 12 head and stabilizing the garment 10 once in position. Also, the chin darts 24 allow additional area for freedom of speech and head movement without disturbing the overall position of the garment 10.

With the structure defined, the operation of the present invention may be described. As can be readily seen, the garment 10 as illustrated in FIGS. 1 through 3 can be easily installed upon the user 12 by placing two hands in the bottom aperture 14 and manually expanding the same to a size sufficient to enable the garment to be lowered about the user's head 12. As the garment is lowered upon the head, the top aperture 20 having a diameter smaller than the circumference of the user's head serves to self-center the garment about the head with the top portion of the user's hair extending therethrough. Further, upon reception of the user's chin within the chin darts 24 of the garment 10, the chin darts 24 initially serve to locate the position of the garment 10 on the user's 12 head and then subsequently serve to stabilize the garment in its proper position. Upon release of the user's hands from the aperture 14, the elastic band 16 in the bottom aperture 12 automatically contracts comfortably about the user's 12 neck, and provides a secure fit to hold the garment in place. With the garment 10 positioned about the head, the bib portion 22 may be manually extended to cover the neck and the chest of the user. Thus, the user 12 may try on clothing while isolating the clothing from direct contact with the user's face thereby insuring against any inadvertent soiling of the cosmetics, facial oils or the like or damage caused by overstretching of the clothing.

Referring to FIG. 4, a second embodiment 10A of the invention is shown. The structure of the garment 10A is similar to the first embodiment except that the garment 10A includes the base aperture 14 and not the top aperture 20. In addition, in this second embodiment, the elastic band 16 preferably extends completely around the aperture 14 until the previously described chin darts 24 being utilized to provide for locating and positioning the garment 10A on the user's 12 head.

Referring to FIG. 5, a third embodiment of the garment 10B is illustrated which is identical to the second embodiment 10A except that the elastic band 16 is disposed only in the back half portion of the aperture 14. This provides certain users with additional comfort while wearing the garment 10.

In use, both second and third embodiments 10A and 10B respectively are initially positioned over the head of the user 12 in the manner previously described by expansion of the aperture 14. In these last two embodiments, however, positioning of the garment 10A and 10B is facilitated primarily by the chin darts 24 and elastic band 16. Once position, those skilled in the art will recognize that a ribbon tie (not shown) may be subsequently extended about the aperture 14 and tightened about the user's neck to hold the garment 10A and 10B in position. Due to the second and third embodiments 10A and 10B possessing less fabric material and manufacturing operations, they of course are preferable for disposable use applications.

Thus, in summary, the present invention provides an economical, convenient and customer-acceptable device by which clothing concerns can protect their inventory of clothing from soiling by customers' cosmetics and the like. In the preferred embodiment, the invention is designed for single use and is easily disposed of after wearing; however, with careful washing, multiple use of the garment is possible.

What is claimed is:

1. A device to protect clothes being put on or removed from a user from becoming soiled or damaged comprising:

a generally bulbous, hood-like garment, having a base portion and upper portion formed of a thin mesh-like fabric and adapted to be worn about the head of a user;

a first aperture formed in the base portion of the garment sized to allow placement of said garment over the head of a user;

resilient means positioned adjacent said aperture for allowing said aperture to be initially expanded to a size sufficient to extend over the head of a user and subsequently contracted to a size sufficient to gather the base portion of the garment about the neck of the user, said garment when positioned about the head of a user forming a barrier preventing direct contact of the user's face with clothes being put on or removed from the user;

an expansion area in said base portion adapted to receive the chin of the user and register said garment upon the user's head; and a second aperture formed in said upper portion of said garment, said second aperture sized to have a circumference less than the circumference of the user's head to locate said garment upon the user's head.

2. The device of claim 1 further comprising a bib portion attached to said base portion sized to extend over the front of the neck and the upper chest of the user.

3. The device of claim 1 wherein said resilient means comprises an elastic band extending throughout the circumference of said aperture.

4. The device of claim 1 wherein said resilient means comprises an elastic band extending throughout the circumference of said aperture.

5. The device of claim 4 wherein said mesh-like fabric is formed of a sheer polypropylene material.

6. A device to protect clothes being put on or removed from a user from becoming soiled or damaged comprising:

a generally bulbous, hood-like garment, having a base portion and upper portion formed of a thin mesh-like fabric and adapted to be worn about the head of a user;

an aperture formed in the base portion of the garment sized to allow placement of said garment over the head of a user;

resilient means positioned adjacent said aperture for allowing said aperture to be initially expanded to a size sufficient to extend over the head of a user and subsequently contracted to a size sufficient to gather the base portion of the garment about the neck of the user, said garment when positioned about the head of a user forming a barrier preventing direct contact of the user's face with clothes being put on or removed from the user; and an expansion area in said base portion adapted to receive the chin of the user to self-register said garment upon the user's head.

* * * * *